US005476574A

United States Patent [19]

Welch et al.

[11] Patent Number: 5,476,574

[45] Date of Patent: Dec. 19, 1995

[54] CONTINUOUS ALUMINA FEEDER

[75] Inventors: Barry J. Welch, Auckland; David J. Stretch, Invercargill, both of New Zealand; Jennifer M. Purdie, Melbourne, Australia

[73] Assignee: Comalco Aluminium Limited, Victoria, Australia

[21] Appl. No.: 256,154

[22] PCT Filed: Jan. 8, 1993

[86] PCT No.: PCT/AU93/00009

§ 371 Date: Sep. 29, 1994

§ 102(e) Date: Sep. 29, 1994

[87] PCT Pub. No.: WO93/14247

PCT Pub. Date: Jul. 22, 1993

[30] Foreign Application Priority Data

Jan. 10, 1992 [NZ] New Zealand ..... 241276

[51] Int. Cl.[6] ..... C25C 3/06; C25C 3/14

[52] U.S. Cl. ..... 204/67; 204/245

[58] Field of Search ..... 204/245, 67

[56] References Cited

U.S. PATENT DOCUMENTS

| | | | |
|---|---|---|---|
| 3,681,229 | 8/1972 | Lowe | 204/245 X |
| 3,839,167 | 10/1974 | Sleppy | 204/245 X |
| 4,016,053 | 4/1977 | Stankovich | 204/245 X |
| 4,321,115 | 3/1982 | Rebmann et al. | 204/245 X |
| 4,328,085 | 5/1982 | Friedli et al. | 204/245 |
| 4,435,255 | 3/1984 | Casdas | 204/245 X |
| 4,437,964 | 3/1984 | Gerphagnon et al. | 204/245 |

FOREIGN PATENT DOCUMENTS

| | | |
|---|---|---|
| 44457/58 | 6/1959 | Australia . |
| 54397/65 | 7/1966 | Australia . |

OTHER PUBLICATIONS

Patent Abstracts of Japan, C–77, p. 3642, JP,A,52–106309 Apr. 1976.
Derwent Abstract Accession No. H9899C/37, Jun. 1978.
Derwent Abstract Accession No. E3845X/19, Apr., 1975.
Derwent Abstract Accession No. 91–139058/19, Jul., 1990.
Derwent Abstract Accession No. 91–316600/43 Mar., 1989.
Derwent Abstract Accession No. 85–104342/17 Jun. 1981.

*Primary Examiner*—Donald R. Valentine
*Attorney, Agent, or Firm*—Nikaido, Marmelstein, Murray & Oram

[57] ABSTRACT

A continuous feeder for feeding alumina to an aluminium reduction cell is positioned over a discharge outlet (114) of an alumina hopper. The feeder includes a flow control valve member (140) which is connected to a positioning means (132) by rod (142). The flow control valve member (140) includes a tapered section such that varying the vertical position of member (140) varies the clearance between the member (140) and an outlet orifice, which allows control over the flow rate of alumina from the hopper. The alumina flow control means is preferably mounted within an elongate tubular member (130), which is further mounted inside a housing (120). Housing (120) allows for removal of the flow control means for maintenance without having to first empty the hopper.

28 Claims, 4 Drawing Sheets

CONTINUOUS ALUMINA FEEDER

BACKGROUND OF THE INVENTION

This invention relates to an apparatus and a method enabling the continuous feeding of alumina to an electrolytic cell for the production of aluminium by the Hall-Heroult process. In this process, aluminium is produced by electrolytic reduction of alumina ($Al_2O_3$) dissolved in a bath of electrolyte contained in the cell which electrolyte is based on molten cryolite. The metal is formed at the molten aluminium cathode and oxygen is discharged at the carbon anode but reacts with and consumes it to form carbon oxides.

An important factor in the efficient production of aluminium by this process is the method whereby the alumina is introduced into the bath. A method using traditional technology involves breaking the frozen crust alumina matrix which covers the surface of the molten electrolyte in the cell in normal operation to form an opening and then dumping a volumetrically measured amount of alumina into the opening. This dumping is done either at periodic intervals or on receipt of a demand feed signal. By way of example, one approach is to break all the crust along half the centre channel width of the cell and dump the volumetric equivalent of approximately 65 kg of alumina into the cell every 30–100 minutes or on a demand feed basis. This causes a major thermal disturbance as the alumina concentration of the electrolyte increases and subsequently decreases as it is electrolytically removed.

Recent experiments with the composition of the electrolyte and the operation of electrolytic cells have indicated that the crust added during the breaking action contributes to operating problems as does the mass of frozen electrolyte alumina matrix that is generated by the thermal shock of a dumping. Consequently, smaller alumina additions have become favoured to reduce the sludging of the alumina and thus increase the efficiency of the system. This has led to the development of point feeding systems where a smaller hole is broken through the crust and the mass of alumina added during each feeding action varies between 0.5 and 3 kg, but the feeding frequency is increased to every 1 to 5 minutes depending on the feed strategy used. Because of the more frequent feeding of smaller quantities of alumina, more than one hole is formed in the crust by pneumatically or mechanically driven pickles (crust breakers). Examples of point or spot feeding systems are given in U.S. Pat. Nos. 3,400,062, 3,689,229 and 4,437,964.

U.S. Pat. No. 4,431,491, assigned to Pechiney, discloses a point feeder for feeding alumina to an electrolytic cell. The apparatus includes a distributor and a piercing tool. The distributor comprises a metering means which contains a fixed quantity of alumina. In operation, the lower part of the metering means is moved downwardly to form an opening through which the fixed quantity of alumina is dumped into a hole in the crust on the cell.

Other point feeders generally incorporate a dosage container which can store a known (and fixed) amount of alumina. The dosage container is periodically operated to dump the dose of alumina into the cell. The dosage container is generally operated in synchronicity with the crust breaking means.

While the point feeding systems have been a bag improvement on the larger dump feeding system, the discontinuous addition of discrete quantities of alumina to the cell still causes inefficient alumina dissolution, a limited amount of sludge formation, and fluctuations in the concentration of alumina in the electrolyte. Modern understanding indicates the desirability of preventing any sludge build up and minimising concentration fluctuations, especially where it is desired to operate the tank with an electrolyte near its freezing point or near its alumina saturation point. It was with this in mind that the apparatus and method of the present invention were devised.

SUMMARY OF THE INVENTION

In a first aspect, the present invention broadly consists in an apparatus suitable for use in continuously feeding alumina to an electrolytic cell for the production of aluminium by electrolysis of alumina dissolved in a molten electrolyte, comprising: a hopper for holding a supply of alumina located over the cell, the hopper having a bottom aperture for discharge of the alumina; and alumina feed control means for discharging alumina from the hopper through the bottom aperture, the alumina feed control means being operable in use to close the bottom aperture of the hopper and prevent discharge of alumina from the hopper and to open the bottom aperture and permit a continuous discharge of alumina at any set rate within a predetermined range of flow rates.

In a preferred embodiment, the alumina feed control means is operable to vary the size of the discharge opening of the aperture to permit a continuous discharge of alumina at any set rate within a predetermined range of flow rates.

The alumina feed control means may comprise a flow control valve member having varying cross-sectional area along its length. The flow control valve member may be adapted to move longitudinally relative to an orifice or aperture to thereby change the area of the orifice or aperture available for the flow of alumina and thereby charge the flow rate of the alumina through the orifice or aperture. The orifice may be defined by an orifice member positioned close to the bottom aperture of the hopper.

The flow control valve member preferably includes a taper between a maximum diameter and a minimum diameter. The flow control valve member may be oriented such that it tapers downwardly or tapers upwardly, although it is preferred that the flow control valve member tapers downwardly. The tapered portion of the flow control valve member is preferably of conical or truncated conical shape. However, other suitable shapes may also be used. For example, the flow control valve member may have a non-circular cross-section. Further, the rate of change of diameter or width of the tapered portion of the flow control valve member need not be constant over the length of the tapered portion.

The flow control valve member may be connected to a positioning means which is operative to control and alter the position of the flow control valve member relative to the orifice or aperture. The positioning means may comprise any suitable means for imparting longitudinal or reciprocating movement to the flow control valve member. The positioning means is preferably pneumatically actuated. Electric actuation may be used, however it will be appreciated that the apparatus is to be used in the environment of an aluminium smelter pot line which is duster, hot and contains strong magnetic fields. For these reasons, electric actuation of the positioning means may be subject to reliability constraints in the absence of special protective or shielding equipment and accordingly electric actuation is generally not preferred.

The preferred actuator is a pneumatically driven linear actuator, although those skilled in the art will realise that there are a number of suitable actuators that may be used. The present invention encompasses the use of any actuators that are able to position and control the flow control valve member to the desired accuracy. The actuator preferably includes feedback means to position and control the position of the flow control valve member. Such feedback means may comprise, for example, a linear resistive transducer.

The flow control valve member may be connected to the positioning means by any suitable rigid connection, such as a rod or tube.

In an especially preferred embodiment of the present invention, the hopper is provided with a housing mounted in the hopper. The housing has an open lower end positioned over the bottom aperture of the hopper. The housing extends upwardly and includes an open or openable upper end. The housing further includes at least one passage, preferably mounted in the lower part of the housing, which allows alumina to flow from the hopper into the housing. The at least one passage may comprise one or more longitudinal slots or windows.

In use, the alumina feed control means is placed in the housing and acts to control the flow of alumina that exits the hopper via the bottom aperture. The housing provides a space within the hopper that remains substantially free of alumina in its upper reaches and this allows the upper portion of the alumina feed control means, including the positioning means, to operate in a substantially clean environment. Indeed, it is preferred that the housing and alumina feed control means are designed and positioned such that only the flow control valve member and orifice member are in contact with the alumina. This results in improved reliability and reduced wear of the alumina feed control means. Importantly, the housing allows removal of the alumina feed control means for maintenance or repair, and subsequent replacement of the alumina feed control means without the necessity of first emptying the hopper of alumina.

The at least one passage in the housing preferably comprises one or more longitudinal slots or windows. The slots are preferably sized and positioned such that alumina that flows into the housing can continue to flow past the alumina feed control means and out of the hopper. The slots should be of a size and position such that variances in the quality of alumina fed to the hopper and the consequent variances in the angle of repose of the alumina are taken into account in maintaining the flow of alumina from the hopper.

In a further aspect, the present invention broadly consists in an alumina feed control means which is preferably suitable for use in the apparatus defined above.

Preferably the alumina feed control means comprises: an orifice member defining an orifice through which alumina can flow; a flow control valve member which passes through the orifice and has different cross-sectional areas along its length, the flow control valve member being movable longitudinally relative to the orifice member to change the area of the orifice available for flow of alumina and thereby change the flow rate of the alumina; and a positioning means to effect a predetermined movement of the flow control valve member.

Preferably the alumina feed control means also comprises an elongated hollow body disposed or disposable in a substantially upright position within the hopper, the body having the orifice member mounted in its lower end and the positioning means mounted to its upper end with a connecting member located within the body and connecting the positioning means and the flow control valve member whereby the former can effect movement of the latter, the body also having a passage towards its lower end to allow alumina from the hopper to flow into the lower end of the body above the orifice member. Where the hopper is provided with a housing for the alumina feed control means this is disposed or disposable in a substantially upright position within the housing.

Preferably the flow control valve member has a taper between a minimum and a maximum diameter which limiting diameters are predetermined by the range of required flow rates.

Preferably the operation of the continuous feed apparatus is controlled by a sensing means which senses the alumina concentration of the electrolyte, but preprogrammed or predetermined feed rates are also possible.

In yet a further aspect, the present invention broadly consists in a method of continuously feeding alumina to an electrolytic cell for the production of aluminium by electrolysis of alumina dissolved in a molten electrolyte and of maintaining the concentration of alumina in the electrolyte substantially at a predetermined level or substantially within a predetermined range of concentrations during the production process, the method comprising the steps of: supplying alumina to a hopper located over the cell and having a bottom opening for discharge of the alumina from the hopper to the cell; obtaining measure of the concentration of the alumina dissolved in the molten electrolyte in the cell; comparing the measured concentration obtained with the predetermined level or range; and operating alumina feed control means associated with the bottom aperture of the hopper to permit a continuous discharge of alumina from the hopper to the molten electrolyte in the cell at a flow rate within a predetermined range of flow rates so as to maintain the alumina concentration in the electrolyte substantially at the predetermined level or within the predetermined range.

At least preferred embodiments of the invention provide:

1. An apparatus and a method whereby the rate of addition of alumina to an electrolytic cell can be controlled to any set value between prescribed limits.
2. An apparatus and a method to direct the alumina to a hole maintained open in the crust in a manner that reduces the chance of closure of that hole.
3. An apparatus that reduces the amount of crust broken into the electrolytic cell as a consequence of the continuous alumina feeding method employed.
4. An apparatus where the movable parts are readily removed and replaced for ease of maintenance and servicing with minimal disruption of the cell operation.
5. An apparatus that gives efficient utilisation of the one or more alumina storage holders above the cell. It is a feature of the invention that it can be applied to conventional storage hoppers used in modern centre-worked or point fed cells.

The inventors have found that because of the rheological properties of smelter grade alumina the flow rate of the alumina powder through an orifice can be related to the thickness and cross-sectional area of the orifice. The actual constant for the flow rate correlation is dependent on the shape of the orifice and geometric arrangement. Typical correlations are illustrated in FIG. 1 where Design A is for a simple cylindrical orifice and Design B is based on the positioning of a partially tapered rod concentric with an orifice. Within certain design ranges the flow rate can be made less sensitive to the quality of the smelter grade alumina. The preferred apparatus of the present invention is based on this finding by the inventors in that, as already indicated, the preferred alumina feed control means uses a flow control valve member movable in an orifice to control the continuous flow rate of the alumina through the orifice.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

DESCRIPTION OF PREFERRED EMBODIMENTS

Figure 1:
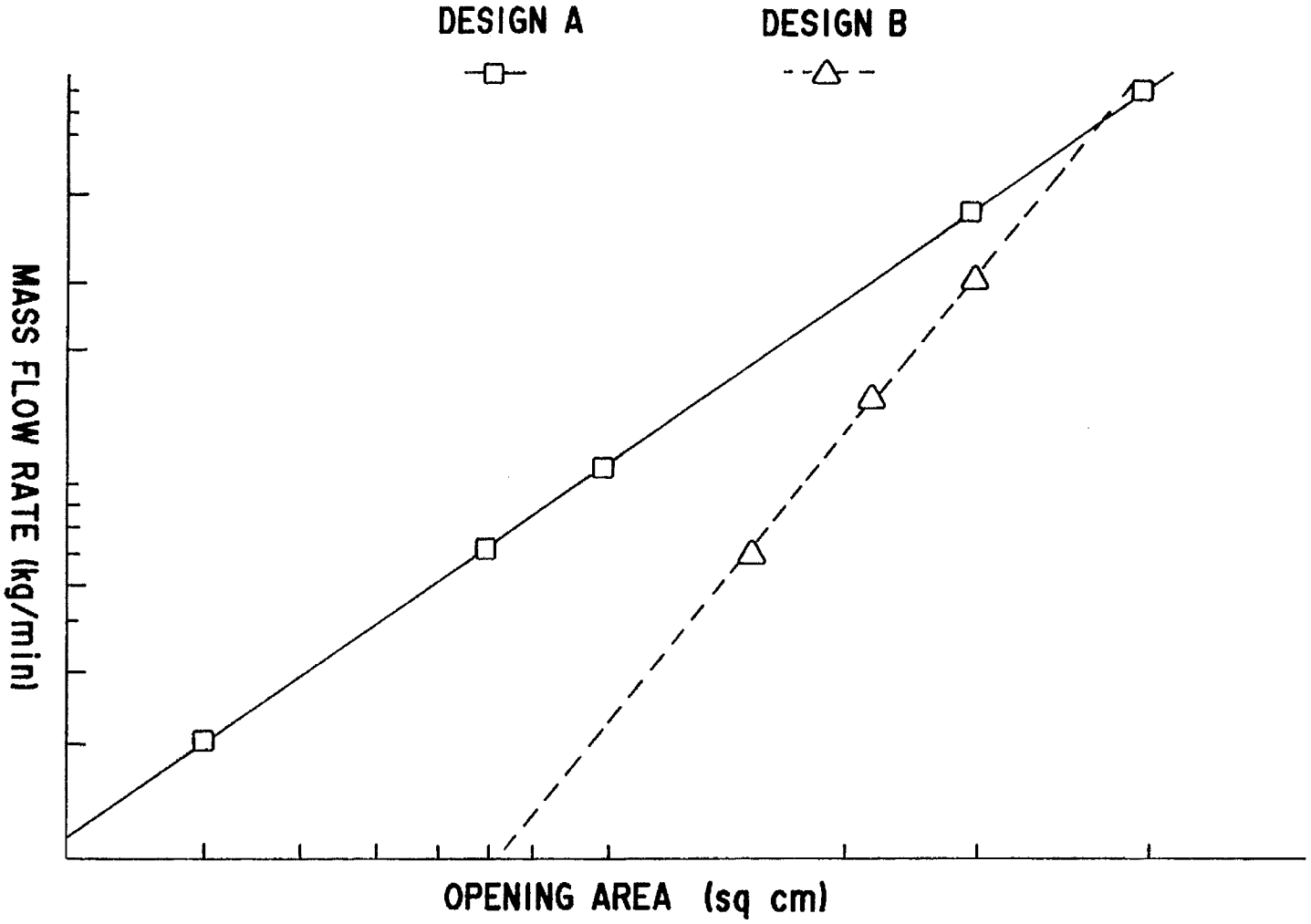
FIG. 1 is, as already indicated above, a graph in which for two designs of orifice the mass flow rate of alumina is plotted against the open area of the orifice.
Figure 2:
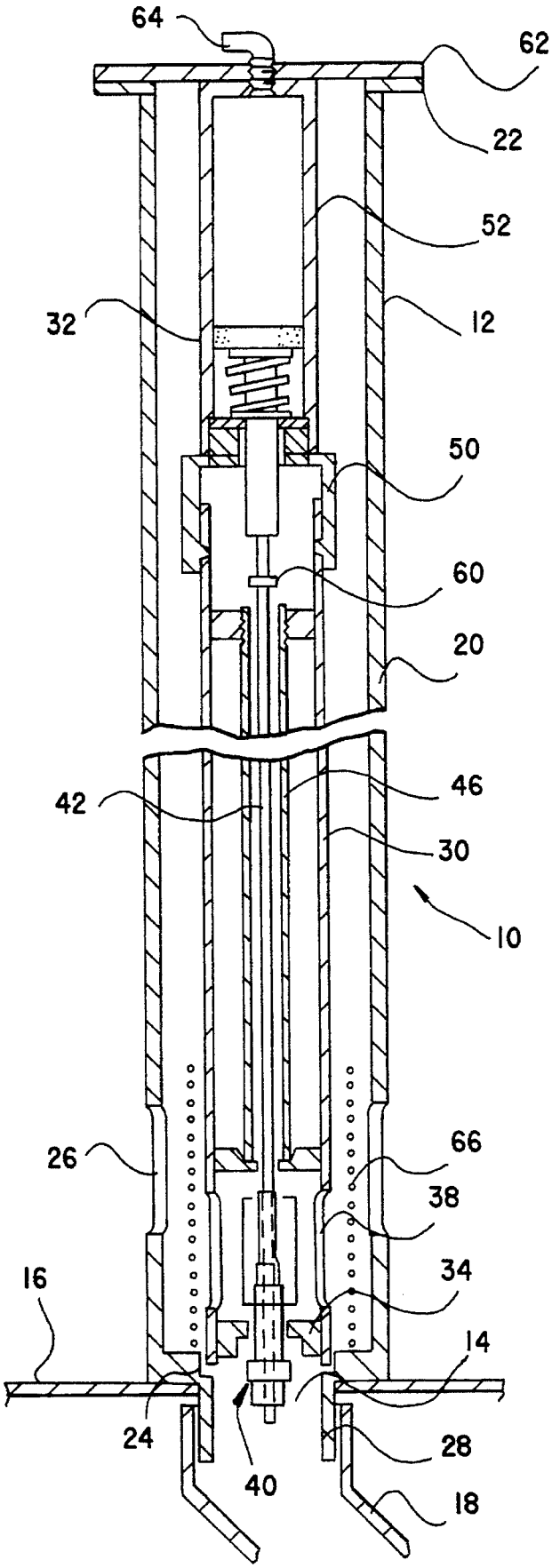
FIG. 2, while not to scale, shows a longitudinal section through a part of a preferred continuous alumina feeding apparatus according to the present invention, showing in particular a preferred alumina feed control means.

In FIG. 2 the alumina feed control means 10 is shown located within its sea, icing housing 12 and positioned over the bottom aperture 14 of the hopper 16. Only a portion of the bottom of the hopper is shown. FIG. 2 also shows the relative position of a discharge chute 18 that directs the alumina which passes through the bottom aperture 14 to the hole maintained through the crust which covers the surface of the molten electrolyte in the electrolytic cell in normal operation. The electrolytic cell and the crust breaking means are not shown in the drawings and are not further described as they may be any suitable types known to those skilled in the art. It is sufficient to say that the crust breaking means, having formed the hole in the crust is operated to maintain that hole so that alumina can be continuously fed to the molten electrolyte beneath the crust. It is highly desirable that the hole be maintained open whenever continuous feeding of alumina to the electrolytic cell is taking place.

The housing 12 is used to locate the alumina feed control means 10 and, to some extent, to protect the alumina feed control means from the alumina normally contained in the hopper. While the housing may be made of either rectangular or tubular metal sections, an illustrative example comprises an elongated metal tube 20 of between 90–125 mm outer diameter terminating with a sealing section at its open upper end such as provided by a flange 22. At the lower end of the housing is a step section 24 for locating the bottom end of the alumina feed control means 10 and giving an effective seal.

The housing 12 has a passage allowing alumina to flow from the hopper to the alumina feed control means 10. The passage can be provided by alumina access ports 26. These, for example, may start between 10 and 40 mm above the lower end of the housing with their height being dependent upon the diameter of the housing. The ports can be made to any suitable width.

The lower end of the housing 12 is attached to the bottom of the hopper 16 and terminates in an appropriate connection system 28 for fitting the discharge chute 18. The length and angle of the discharge chute are designed to ensure the flowing alumina powder is directed to the centre of the opening provided in the crust above the molten electrolyte in the electrolytic cell. The discharge chute 18 is preferably removable and preferably has a mechanism for sealing and preventing alumina flow when the alumina feed control means 10 is removed from the housing 12 for servicing.

Figure 3:
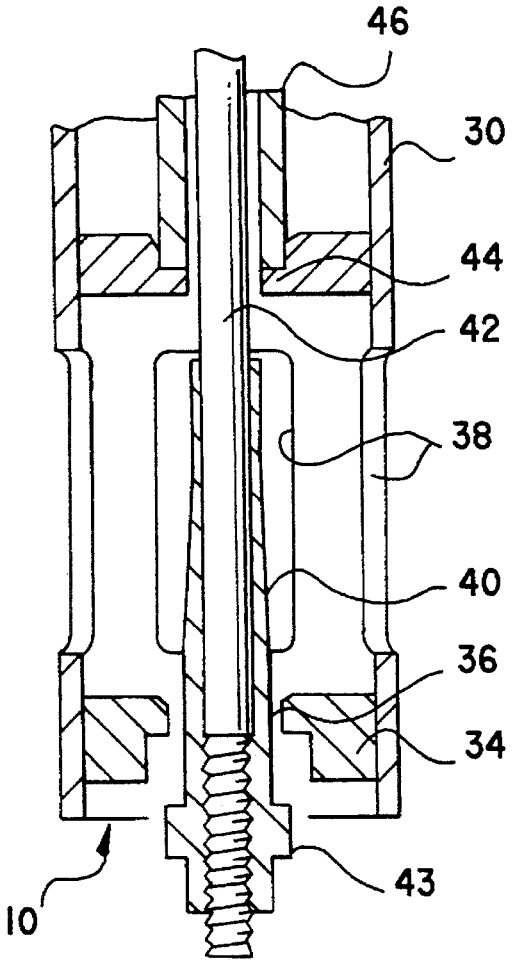
FIG. 3 shows a longitudinal section through the lower end of the alumina feed control means shown in FIG. 2.
Figure 4:
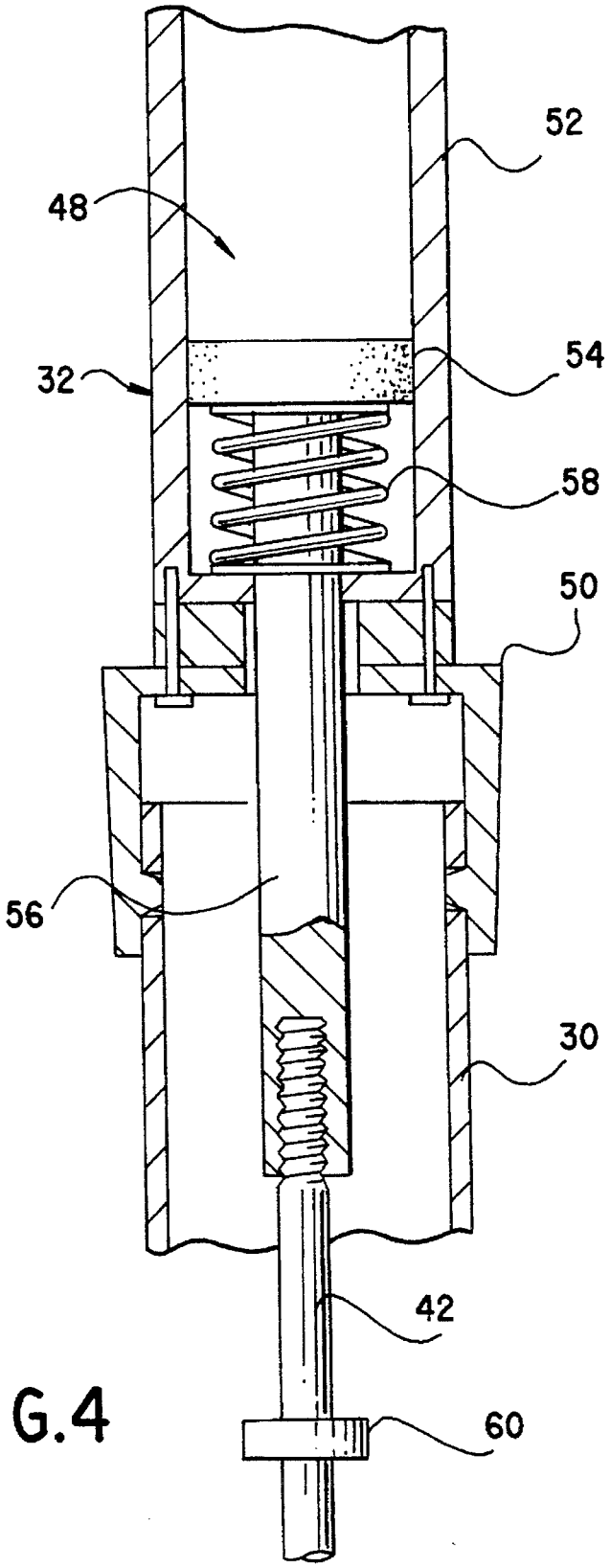
FIG. 4 shows a longitudinal section through the upper end of the alumina feed control means shown in FIG. 2.

Referring to FIGS. 2, 3 and 4, the preferred alumina feed control means 10 has an elongated hollow body 30. While this can also be made of rectangular or tubular metal sections, a tubular section is preferred and typically this has a diameter between 50–80 mm. The overall length of the tubular body is dependent on the length of the locating and servicing housing 12 taking into account also the space within the housing required by the positioning means 32 located above the tubular body 30.

Within the lower end of the tubular body 30 (see FIG. 3) there is an orifice member 34 defining an alumina flow control orifice 36. A passage is provided for flow of alumina from the hopper to the orifice. The passage is conveniently provided by alumina flow access ports 38 provided in the tubular body 30 just above the orifice member 34. The height and width of these access ports is dependent on the selected diameter of the tubular body 30. By way of example, for a tubular body having a diameter of 61 mm an adequate size of each of four alumina access ports would be about 30 mm in width by 40 mm in height.

Concentric with the alumina flow orifice 36 is a height adjustable, partially tapered alumina flow control valve member 40. The valve member is mounted on the lower end of a connecting member which operates as a height adjustment push-rod 42. It is preferable that both the orifice member 34 and the valve member 40 are made of an abrasive and wear-resistant material. This may comprise either a refractory material or special surface treated metals. Furthermore, it is preferable that both the orifice member and the valve member are replaceable. The valve member may be screwed onto the lower end of the push-rod.

The orifice 36 has any suitable diameter but typically has a diameter between 15 to 25 mm. The length of the valve member is dependent on both the shape of the orifice and the mechanism of the positioning means used to adjust its position, but is preferably greater than about 50 mm. The taper of the valve member varies between a maximum diameter approaching that of the orifice and a minimum diameter approaching that of the push-rod. To the underside of the orifice member, the valve member has a flange 43 which limits the upwards movement of the valve member and can also assist in closing the orifice.

The location of the valve member 40 is aided by a locater guide 44 positioned in the tubular body 30 at a convenient height above the access ports 38 and by a guide tube 46 which extends from the locater guide towards the upper end of the tubular body 30. The push-rod 42 passes through the locater guide and guide tube and extends to the adjusting mechanism of the positioning means 32 mounted on the upper end of the tubular body.

FIG. 4 shows a suitable positioning means 32 used for positioning the valve member 40 relative to the orifice member 34. This particular positioning means comprises a pneumatic ram 48. As already indicated, the pneumatic ram is preferably mounted directly onto the upper end of the tubular body 30 and this can be effected by, for example, a Camlock cap fitting 50. The ram comprises a cylinder 52, a piston 54 and a piston rod 56. The piston rod is connected to the upper end of the push-rod 42, for example, by the push-rod being screwed into the free end of the piston rod. The pneumatic ram is used to move the push-rod and hence the valve 40 up and down to control the degree of opening of the orifice 36, this thereby controlling the rate of flow of alumina through the orifice. The pneumatic ram 48 shown in FIG. 4 is a single acting ram having its piston 54 biased to the upper position by a spring 58 to ensure that the orifice is closed when the pneumatic ram is not actuated. A limit collar 60 can be provided on the push-rod to limit its downward movement and hence the extent to which the orifice can be opened.

A cap 62 is attached to the top end of the cylinder 52. This is used to help locate the alumina feed control means 10 within the servicing housing 12. As shown in FIG. 2, the periphery of the cap sits on the flange 22 and is releasably attached thereto. The cap also provides a pneumatic connection 64 for the pneumatic ram.

A screen 66 may be placed within the housing 12 to prevent larger particles of foreign material entering the alumina feed control means 10 and clogging the orifice 36. Alternatively, the screen may be located on top of the hopper, which facilitates cleaning of the screen. It will be appreciated that the screen may be located in any convenient position that results in the alumina being screened prior to flowing through the feed control means.

The operation of the pneumatic ram 48 may be controlled by sensing means known in the art which senses the concentration of alumina in the electrolyte and operates the feed control means to maintain the concentration substantially at a predetermined level or substantially within a predetermined range of concentrations during the period of production of aluminium by electrolysis in the tank. Because the electrical resistivity of the electrolyte varies according to the concentration of alumina therein, measurements of the electrical resistance of the electrolyte be used to generate signals to electrical control means controlling the operation of the pneumatic ram and hence of the feed control means. This measurement can be performed continuously and continuously compared with the predetermined value or range so that while the feed control means will normally provide continuous feeding of alumina to the tank during its operation to replace the alumina being consumed by the process, the rate of replacement can vary according to any variation in the rate of consumption where the feed control means is able to produce a variable flow rate of alumina as is the case with the preferred apparatus.

The above describes a preferred embodiment of the present invention and indicates some possible modifications. However, as will be appreciated by those skilled in the art to which the invention relates, other modifications can be made without departing from the scope of the invention as has been broadly defined.

For example, instead of using a pneumatic ram 48 to move the push-rod 42 and valve member 40, a hydraulic ram can be used. Alternatively, other options include an electric motor and cam positioning. Where an electric synchronous motor is used, this can be made to rotate the push-rod which has a threaded section passing through a fixed threaded plate, the direction of rotation determining whether the push-rod is extended or retracted with the valve member being moved accordingly.

While a Camlock fitting is considered convenient for mounting the pneumatic ram, other types of connections can be used.

The components of the apparatus can be made of any suitable materials. Preferably some of them should be made of wear-resistant ceramics or metals. This includes components such as the valve member 40, the orifice member 36 and the locater guide 44.

The discharge chute 18 need not be as shown in FIG. 2 but may be of any suitable design that will direct the flowing alumina powder to the opening in the crust.

The dimensions of the various components are chosen to achieve the flow rate or flow rates which are desired in practice and this varies with cell technologies and the number of such devices that are fitted into each alumina storage hopper. The length of the tapered valve member can be adjusted to the desired stroke of the push-rod and thickness of the orifice member. While it is preferable for this to have a tapered section, multiple steps of a cylindrical nature are an acceptable variation. This member can also have shaping variations such as fluting and the like.

The arrangement of the valve member 40 so far described has it moving downwardly with respect to the orifice member 36 to increase the opening for alumina flow. However, in another arrangement the valve member is inverted so that moving it upwardly increases the size of the orifice. In this case the operation of the pneumatic ram 48 is reversed and its spring 58 is arranged to bias the piston 54 downwardly. Of course it is also possible to have an arrangement where the valve member 40 is fixed relative to the hopper and it is the orifice member which is moved to alter the size of the orifice.

The housing 12 is not an essential component of the invention. It is presently desirable for convenience of interchange but interchange may be less important in the future, for example, as the reliability and wear resistance of components improve the advantages of having a housing diminish. Where there is no housing, the alumina feed control means is preferably still capable of being removed from the hopper for servicing though, in another embodiment, may be a permanent part of the hopper.

Figure 5:
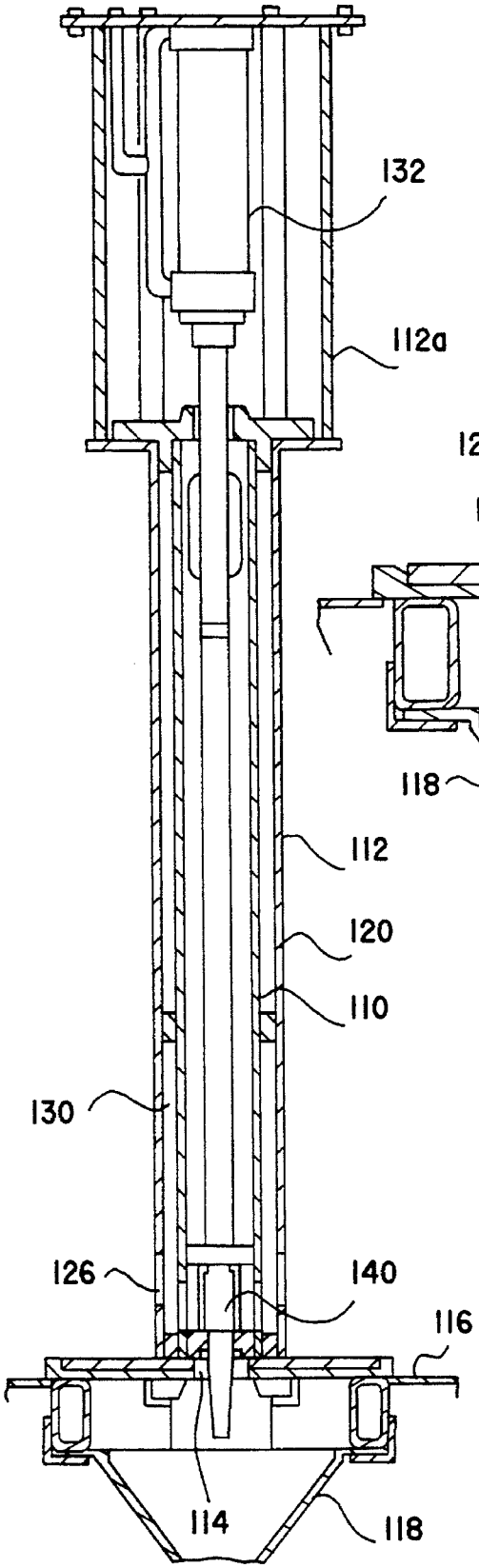
FIG. 5 shows a longitudinal section through part of an especially preferred continuous alumina feeding apparatus according to the present invention.
Figure 6:
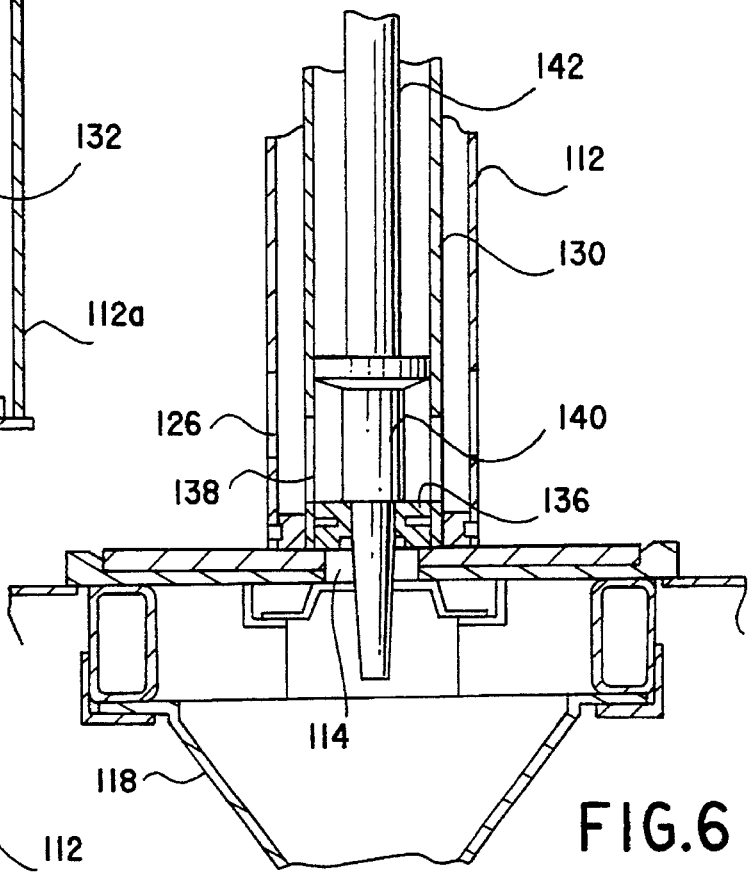
FIG. 6 shows a longitudinal section through the lower end of the alumina feed control means shown in FIG. 5.

The embodiment of the present invention shown in FIGS. 5 and 6 is similar to the embodiment shown in FIGS. 2, 3 and 4, with some modifications made thereto. Referring to FIG. 6, it can be seen that partially tapered alumina flow control valve member 140 is positioned such that the alumina flow control valve member tapers from its maximum diameter to its minimum diameter in a downwards direction. In the embodiment shown in FIG. 6, the alumina flow control valve member is shown in its lowermost position in which alumina flow control orifice 136 is completely closed to the flow of alumina. It will be appreciated that components 136 and 140 are preferably designed for wear resistance.

FIG. 6 also shows service housing 112 having alumina access ports 126 in the form of longitudinal slots. The apparatus also includes an elongate, tubular hollow body 130 which also includes alumina access ports 138. Alumina flow control valve member 140 is connected to rod 142 which in turn is connected to positioning means 132 (see FIG. 5). As can be seen in FIG. 6, elongate tubular hollow body 130 assists in aligning flow control valve means 140 with orifice 136.

Use of the flow control valve member oriented such that it tapers downwardly, as shown in FIGS. 5 and 6, allows the flow control valve member to be completely withdrawn from the orifice to provide a higher maximum flow rate than the apparatus of FIGS. 2, 3 and 4. This can be especially important when an anode effect occurs in the cell and it becomes necessary to rapidly increase the alumina concentration in the cell. Furthermore, use of the flow control valve in a downwardly tapering orientation allows easier clearance of blockages in the orifice by:

i) permitting complete withdrawal of the flow control valve member from the orifice, or, in some instances;

ii) lowering the flow control valve member to crush the blocking particles between the flow control valve member and the orifice.

Referring to FIG. 5, it can also be seen that the construction of the upper part of the apparatus differs slightly from the apparatus shown in FIGS. 2, 3 and 4. In particular, the upper part of the apparatus includes housing 112*a* having a larger diameter than housing 112. Housing 112*a* contains positioning means 132. It will be appreciated that housing 112*a* may be mounted inside the hopper or mounted above the hopper.

Positioning means 132 may comprise a pneumatically driven linear actuator. The actuator includes a linear resistive transducer (not shown) to determine the position of the flow control valve member. This system is suitable to be actuated by pot line air supply and is able to position the flow control valve means to within 1 mm of its set point. It will be appreciated other suitable means for controlling and actuating the flow control valve member may be used in the present invention. The actuator is preferably arranged to control the position of the flow control valve member in response to signals related to the concentration of alumina in the bath. Other control strategies, e.g. establishment and maintenance of constant alumina flow rate, may also be used.

Operational use of the apparatus of the present invention has revealed that the apparatus is somewhat prone to blocking at low orifice—flow control valve member clearances. To minimise blockages, the following strategies may be used:

i) the alumina may be screened to remove larger particles. The apparatus may include a screen, such as screen 66, as shown An FIG. 2, a screen may be positioned above the hopper or the alumina screened prior to being fed to the hopper.

ii) use of large orifice/flow control valve member clearances for any desired flow rate. This may be achieved by use of the smallest suitable orifice size possible for the design flow rate. The size of the orifice used in the apparatus will necessarily be a compromise between the requirement for large orifice/valve member clearance and the maximum alumina flow rate required to be provided in times of excursions into non-optimal operating conditions in the cell, e.g. anode effect. Those skilled in the art will be able to readily determine dimensions of the orifice and the valve member, iii) use of a control strategy that includes the periodic enlargement of the orifice by withdrawing or partially withdrawing the flow control valve means. This allows any blockages that may have developed to be cleared by increasing the orifice-flow control valve member clearance. Opening of the orifice may take place in response to signals indicating a blockage of the orifice (e.g. by use of signals measuring the flow rate through the orifice). As another possibility, the control system of the cell may open or partially open the orifice once every 30 minutes to 2 hours (say) to clear any blockages.

It is believed that the flow control valve member need be partially withdrawn from the orifice for a period of time as short as 1 second to clear any blockages. Such short periods of increased flow will not unduly affect the overall flow rate of alumina to the cell.

Figure 7:
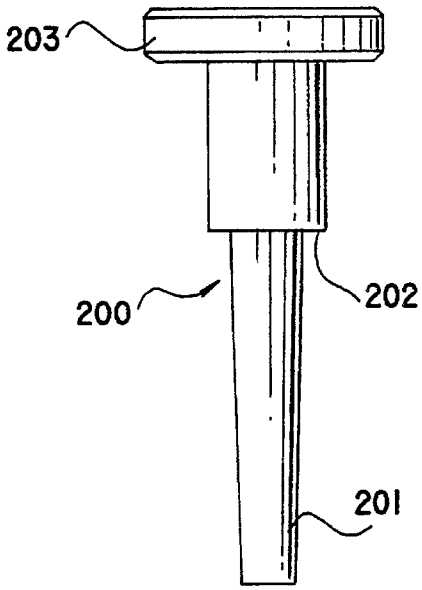
FIG. 7 shows a schematic diagram of a preferred flow control valve member.

A number of variations on the shape of the flow control valve member may be incorporated into the apparatus of the present invention, the only constraint being that the flow control valve member includes a portion where its cross-sectional area varies in the longitudinal direction. One possible design is shown in FIG. 7. In this embodiment, flow control valve member 200 includes tapered section 201. The tapered section 201 has shoulder 202 located at its upper end. Shoulder 202 is used to seal the orifice when the valve is closed. The upper end of flow control valve member 200 includes enlargement 203 which closely fits with the inner housing and assists in aligning the flow control valve member.

Variations in this design are possible and all such variations fall within the scope of the present invention. For example, a cylindrical extension may be located below tapered portion 201. The flow control valve member may also include one or more slots in its outer surface, or a flow passage arranged to pass therethrough. These arrangements may assist in maintaining a constant flow rate of alumina at small orifice/valve member clearances.

In order to demonstrate the ability of the present invention to continuously deliver alumina to an electrolyte cell, a flow test using the apparatus of FIG. 5 was carried out. The alumina had been screened to remove any particles larger than the orifice-flow control valve clearance at the operating point. The apparatus was operated at a single set point for a two hour period and the average alumina flow rates determined for six different time intervals during the test. The results obtained from the test are shown in Table 1. As can be seen, there was no significant difference in the average alumina flow rate over the two hour period.

TABLE 1

| Time (minute) | Average Flow Rate (kg/min) | Average (S.D.) over one hour (kg/min) |
|---|---|---|
| 0.20 | 0.483 | 0.482 |
| 30–40 | 0.480 | (0.0017) |
| 45–50 | 0.483 | |
| 60–80 | 0.480 | 0.479 |
| 100–110 | 0.47 | (0.095) |
| 115–120 | 0.489 | |

We claim:

1. An apparatus for continuously supplying alumina to an electrolytic cell for the production of aluminum by electrolysis of alumina dissolved in a molten electrolyte, comprising: a hopper for holding a supply of alumina located over the cell, the hopper having a bottom aperture for discharge of the alumina; and alumina feed control means for discharging alumina from the hopper through the bottom aperture, wherein the alumina feed control means includes a flow control valve member having varying cross-sectional area along its length, said flow control valve member being adapted to be moved longitudinally relative to the aperture to change the area of the orifice available for flow of alumina and thereby change the flow rate of the alumina, the alumina feed control means being operable in use to close the bottom aperture of the hopper and prevent discharge of alumina from the hopper and to open the bottom aperture and vary the size of the discharge opening of the aperture to permit a continuous discharge of alumina at any set rate within a predetermined range of flow rates.

2. Apparatus as claimed in claim 1 wherein the alumina flow control means further comprises a positioning means, the flow control valve means being connected to the positioning means, the positioning means being effective to control the position of the flow control valve member.

3. Apparatus as claimed in claim 2 wherein said positioning means comprises a pneumatically driven linear actuator.

4. Apparatus as claimed in claim 3 wherein the positioning means further includes a linear resistive transducer to provide feedback as to the position of the flow control valve member.

5. Apparatus as claimed in claim 1 wherein the flow control valve member is mounted on a rod and the rod is connected to the positioning means.

6. Apparatus as claimed in claim 1 wherein the alumina feed control means is located within a housing mounted within the hopper, the housing having an open lower end positioned over the bottom aperture and an open or openable upper end, the housing including at least one passage allowing alumina to flow from the hopper and through the bottom aperture, the alumina feed control means being removable from and replaceable in the housing by way of its upper end.

7. Apparatus as claimed in claim 1 wherein said alumina feed control means further comprises an elongate hollow body disposed or disposable in a substantially upright position within the hopper, the body having the orifice member mounted in its lower end and the positioning means mounted to its upper end with a connecting member located within the body and connecting the positioning means and the flow control valve member whereby the former can effect movement of the latter, the body also having a passage towards its lower end to allow alumina from the hopper to flow into the lower end of the body above the orifice member.

8. Apparatus as claimed in claim 7 wherein the elongate hollow body is disposed within the housing.

9. Apparatus as claimed in claim 1 further comprising transfer means operatively associated with said bottom aperture to direct the alumina to a desired position in the cell.

10. Apparatus as claimed in claim 9 wherein the transfer means comprises a conduit connected to the bottom aperture.

11. Apparatus as claimed in claim 1 wherein said apparatus is associated with a point breaker which is operative to maintain a hole in the crust on the surface of the electrolysis cell and alumina is continuously delivered to the hole.

12. An apparatus suitable for continuously feeding particulate alumina to an electrolytic cell for the production of aluminium by the electrolysis of alumina comprising:

a hollow elongate housing positioned over an aperture in an alumina hopper, the alumina hopper being located above the electrolytic cell, the housing having one or more longitudinal slots to allow the passage of alumina through the housing and out of the hopper via the aperture, alumina feed control means mounted within the housing, the alumina feed control means comprising an orifice member located in close proximity to the aperture, a flow control valve member which is insertable into the orifice member and has varying cross-sectional area over at least a portion of its length, positioning means to which the flow control valve member is connected, the positioning means being effective to move the flow control valve member in a longitudinal direction relative to the orifice member and to control the position of the flow control valve member, an inner elongate hollow body disposed or disposable in a substantially upright position within the hopper, the body having the orifice member mounted in its lower end and the positioning means mounted to its upper end, the flow control valve member being located within the inner elongate hollow body, the elongate hollow body including at least one passage located to allow alumina to flow into the body above the orifice member, the inner elongate hollow body being sized and located to assist in aligning the flow control valve member with the orifice member, wherein in use alumina flows through the one or more longitudinal slots in the housing and the at least one passage in the inner elongate hollow member and thereafter through the orifice, and the flow control valve member is positioned relative to the orifice member to permit a continuous flow of alumina at a desired flow rate, the flow control valve member being moved relative to the orifice to alter the area available for flow of alumina through the orifice to effect any required change in the flow rate of alumina.

13. A method of continuously feeding alumina to an electrolytic cell for the production of aluminum by electrolysis of alumina dissolved in a molten electrolyte and of maintaining the concentration of alumina in the electrolyte substantially at a predetermined level or substantially within a range of concentrations during the production process, the method comprising the steps of: supplying alumina to a hopper located over the cell and having a bottom opening for discharge of the alumina from the hopper to the cell; obtaining a measure of the concentration of the alumina dissolved in the molten electrolyte in the cell; comparing the measured concentration obtained with the level or range; and operating alumina feed control means associated with the bottom aperture of the hopper wherein the alumina feed control means includes a flow control valve member having varying cross-sectional area along its length, said flow control valve member being adapted to be moved longitudinally relative to a discharge aperture to change the area of the aperture available for flow of alumina and thereby change the flow rate of the alumina to permit a continuous discharge of alumina at any set rate within a range of flow rates to permit a continuous discharge of alumina from the hopper to the cell at a flow rate within a range of flow rates so as to maintain the alumina concentration in the electrolyte substantially at the level or within the range.

14. An alumina feed control means comprising an orifice member defining an orifice through which alumina can flow; a flow control valve member which passes through the orifice and has different cross-sectional areas along its length, the flow control valve member being movable longitudinally relative to the orifice member to change the area of the orifice available for flow of alumina and thereby change the flow rate of the alumina; and a positioning means to effect a predetermined movement of the flow control valve member.

15. An alumina feed control means as claimed in claim 14 further comprising an elongated hollow body disposed or disposable in a substantially upright position within a hopper, the body having the orifice member mounted in its lower end and the positioning means mounted to its upper end with a connecting member located within the body and connecting the positioning means and the flow control valve member whereby the former can effect movement of the latter, the body also having a passage towards its lower end to allow alumina from the hopper to flow into the lower end of the body above the orifice member.

16. An apparatus for continuously supplying alumina to an electrolytic cell for the production of aluminum by electrolysis of alumina dissolved in a molten electrolyte, comprising: a hopper for holding a supply of alumina located over the cell, the hopper having a bottom aperture for discharge of the alumina; and alumina fee control means for discharging alumina from the hopper through the bottom aperture wherein the alumina feed control means includes a flow control valve member having a taper between a maximum diameter and a minimum diameter along its length, said flow control valve member being adapted to be moved longitudinally relative to the aperture to change the area of the orifice available for flow of alumina and thereby change the flow rate of the alumina, the alumina feed control means being operable in use to close the bottom aperture of the hopper and prevent discharge of alumina from the hopper and to vary the size of the discharge opening of the aperture to permit a continuous discharge of alumina at any set rate within a predetermined range of flow rates.

17. Apparatus as claimed in claim 16, wherein said flow control valve member is positioned such that the member tapers from the maximum diameter to the minimum diameter in a downwards direction.

18. Apparatus as claimed in claim 16 wherein said flow control valve member is positioned such that the member tapers from the maximum diameter to the minimum diameter in an upwards direction.

19. Apparatus as claimed in claim 16 wherein the alumina flow control means further comprises a positioning means, the flow control valve means being connected to the positioning means, the positioning means being effective to control the position of the flow control valve member.

20. Apparatus as claimed in claim 19 wherein said positioning means comprises a pneumatically driven linear actuator.

21. Apparatus as claimed in claim 20 wherein the positioning means further includes linear resistive transducer to provide feedback as to the position of the flow control valve member.

22. Apparatus as claimed in claim 16 wherein the flow control valve member is mounted on a rod and the rod is connected to the positioning means.

23. Apparatus as claimed in claim 16 wherein the alumina feed control means is located within a housing mounted within the hopper, the housing having an open lower end positioned over the bottom aperture and an open or openable upper end, the housing including at least one passage allowing alumina to flow from the hopper and through the bottom aperture, the alumina feed control means being removable from and replaceable in the housing by way of its upper end.

24. Apparatus as claimed in claim 16 wherein said alumina feed control means further comprises an elongate hollow body disposed or disposable in a substantially upright position within the hopper, the body having the orifice member mounted in its lower end and the positioning means mounted to its upper end with a connecting member located within the body and connecting the positioning means and the flow control valve member whereby the former can effect movement of the latter, the body also having a passage towards its lower end to allow alumina from the hopper to flow into the lower end of the body above the orifice member.

25. Apparatus as claimed in claim 24 wherein the elongate hollow body is disposed within the housing.

26. Apparatus as claimed in claim 16 further comprising transfer means operatively associated with said bottom aperture to direct the alumina to a desired position in the cell.

27. Apparatus as claimed in claim 26 wherein the transfer means comprises a conduit connected to the bottom aperture.

28. Apparatus as claimed in claim 16 wherein said apparatus is associated with a point breaker which is operative to maintain a hole in the crust on the surface of the electrolysis cell and alumina is continuously delivered to the hole.

* * * * *